US010488115B2

(12) United States Patent
Katsumata et al.

(10) Patent No.: US 10,488,115 B2
(45) Date of Patent: Nov. 26, 2019

(54) MULTI-CHAMBER HEAT TREATMENT DEVICE

(71) Applicants: IHI Corporation, Tokyo (JP); IHI Machinery and Furnace Co., Ltd., Tokyo (JP)

(72) Inventors: Kazuhiko Katsumata, Inuyama (JP); Kaoru Isomoto, Tokyo (JP); Akira Nakayama, Hikari (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 0 days.

(21) Appl. No.: 15/646,489

(22) Filed: Jul. 11, 2017

(65) Prior Publication Data

US 2017/0307296 A1 Oct. 26, 2017

Related U.S. Application Data

(63) Continuation of application No. PCT/JP2016/051556, filed on Jan. 20, 2016.

(30) Foreign Application Priority Data

Mar. 4, 2015 (JP) ..... 2015-042635

(51) Int. Cl.
*F27D 9/00* (2006.01)
*F27B 5/04* (2006.01)
(Continued)

(52) U.S. Cl.
CPC ..... *F27D 9/00* (2013.01); *C21D 1/00* (2013.01); *C21D 1/613* (2013.01); *C21D 1/62* (2013.01);
(Continued)

(58) Field of Classification Search
CPC ..... F27D 2009/0075; F27D 2009/0081; F27D 9/00; F27D 2007/045; C23C 8/20;
(Continued)

(56) References Cited

U.S. PATENT DOCUMENTS 5,052,923 A * 10/1991 Peter ..... C21D 1/773 219/390
5,273,585 A * 12/1993 Shoga ..... C21D 1/74 118/719
(Continued)

FOREIGN PATENT DOCUMENTS

EP 0 995 960 B1 1/2005
EP 1 333 105 B1 4/2008
(Continued)

*Primary Examiner* — Steven S Anderson, II
(74) *Attorney, Agent, or Firm* — Rothwell, Figg, Ernst & Manbeck, P.C.

(57) ABSTRACT

A multi-chamber heat treatment device according to the present disclosure in which heating chambers are disposed with an intermediate transport chamber interposed therebetween in a top view, and a treatment object is stored in a heating chamber via the intermediate transport chamber, wherein the multi-chamber heat treatment device includes a gas cooling chamber which cools the treatment object using a cooling gas; and a cooling gas circulation device which includes an gas inlet and a gas outlet.

11 Claims, 3 Drawing Sheets

(51) Int. Cl.

| | |
|---|---|
| ***F27B 5/02*** | (2006.01) |
| ***C21D 1/00*** | (2006.01) |
| ***C21D 1/62*** | (2006.01) |
| ***C21D 9/00*** | (2006.01) |
| ***C21D 1/613*** | (2006.01) |
| *F27D 7/04* | (2006.01) |

(52) U.S. Cl.
CPC ..... *C21D 9/0018* (2013.01); *C21D 9/0062* (2013.01); *F27B 5/02* (2013.01); *F27B 5/04* (2013.01); *F27D 2007/045* (2013.01); *F27D 2009/0075* (2013.01); *F27D 2009/0081* (2013.01)

(58) Field of Classification Search
CPC ..... C23C 8/22; F27B 5/02; F27B 5/04; C21D 1/00; C21D 1/62; C21D 1/613; C21D 9/0018; C21D 9/0062
See application file for complete search history.

(56) References Cited

U.S. PATENT DOCUMENTS

| | | | | |
|---|---|---|---|---|
| 5,871,806 | A | 2/1999 | Shoga et al. | |
| 6,913,449 | B2 * | 7/2005 | Loeser | C21D 1/613 266/250 |
| 8,152,935 | B2 * | 4/2012 | Katsumata | C23C 8/22 148/223 |
| 2002/0031740 | A1 * | 3/2002 | Garn | F27B 5/06 432/77 |
| 2003/0113186 | A1 * | 6/2003 | Hiramoto | C21D 1/773 414/147 |
| 2003/0145907 | A1 * | 8/2003 | Edenhofer | C21D 9/0062 148/217 |
| 2006/0118209 | A1 | 6/2006 | Edenhofer | |
| 2006/0119021 | A1 | 6/2006 | Edenhofer | |
| 2007/0122761 | A1 * | 5/2007 | Katsumata | C21D 9/0062 432/77 |
| 2007/0212657 | A1 * | 9/2007 | Katsumata | F27B 5/04 432/77 |
| 2008/0073001 | A1 | 3/2008 | Katsumata | |
| 2013/0019796 | A1 * | 1/2013 | Yamada | C21D 1/74 118/47 |
| 2013/0153547 | A1 * | 6/2013 | Katsumata | C21D 1/09 219/121.58 |
| 2015/0381014 | A1 * | 12/2015 | Lee | H02K 9/19 310/54 |

FOREIGN PATENT DOCUMENTS

| | | | | |
|---|---|---|---|---|
| JP | 5-5171 | A | | 1/1993 |
| JP | 8-178535 | A | | 7/1996 |
| JP | 11-153386 | A | | 6/1999 |
| JP | 2003-183728 | A | | 7/2003 |
| JP | 2004-84997 | A | | 3/2004 |
| JP | 2005-9702 | A | | 1/2005 |
| JP | 2005009702 | A | * | 1/2005 |
| JP | 2005-29872 | A | | 2/2005 |
| JP | 2006-266615 | A | | 10/2006 |
| JP | 2008-81781 | A | | 4/2008 |
| JP | 2014-51695 | A | | 3/2014 |

* cited by examiner

MULTI-CHAMBER HEAT TREATMENT DEVICE

CROSS-REFERENCE TO RELATED APPLICATIONS

The present application is a continuation application of International Application No. PCT/JP2016/051556, filed Jan. 20, 2016, which claims priority to Japanese Patent Application No. 2015-042635, filed Mar. 4, 2015. The contents of these applications are incorporated herein by reference in their entirety.

TECHNICAL FIELD

The present disclosure relates to a multi-chamber heat treatment device.

BACKGROUND

Patent Document 1 listed below discloses, as a multi-chamber vacuum heating furnace in which a heating chamber and a cooling chamber are disposed adjacent to each other with a partition wall interposed therebetween, a multi-chamber type multi-cooled vacuum furnace in which a heat treatment article is subjected to a cooling treatment by blowing a cooling gas toward the heat treatment article from gas nozzles provided to surround the heat treatment article in a cooling chamber.

Meanwhile, the following Patent Document 2 discloses a multi-chamber heat treatment device in which three heating chambers and a single cooling chamber are disposed with an intermediate transport chamber interposed therebetween, and a desired heat treatment is performed on a treatment object by moving the treatment object between the three heating chambers and the single cooling chamber via the intermediate transport chamber. The cooling chamber in the multi-chamber heat treatment device is disposed below the intermediate transport chamber, and uses a liquid or mist-like cooling medium to cool the treatment object carried in the cooling chamber from the intermediate transport chamber by a dedicated lifting device. The following Patent Documents 3 to 5 also disclose background techniques related to a multi-chamber heat treatment device.

DOCUMENTS OF THE RELATED ART

Patent Document

[Patent Document 1]
Japanese Unexamined Patent Application, First Publication No. H11-153386
[Patent Document 2]
Japanese Unexamined Patent Application, First Publication No. 2014-051695
[Patent Document 3]
Japanese Unexamined Patent Application, First Publication No. H08-178535
[Patent Document 4]
Japanese Unexamined Patent Application, First Publication No. 2005-29872
[Patent Document 5]
Japanese Unexamined Patent Application, First Publication No. 2005-9702

SUMMARY

Incidentally, the multi-chamber heat treatment device disclosed in Patent Document 2 uses a liquid or mist-like cooling medium, and among the multi-chamber heat treatment devices having the intermediate transport chamber, a multi-chamber heat treatment device adopting a cooling system using a gas as a cooling medium (gas cooling system) has not been developed. Comparing a gas cooling system with a mist cooling system, in principle, the cooling efficiency of a gas cooling system is worse than the cooling efficiency of a mist cooling system. Therefore, changing the mist cooling type to the gas cooling type is not suitable because the cooling efficiency is greatly lowered.

The present disclosure has been made in view of the aforementioned circumstances, and an object thereof is to provide a multi-chamber heat treatment device in which a decrease in cooling performance in the mist cooling is suppressed.

In order to achieve the aforementioned objects, an aspect of the present disclosure is a multi-chamber heat treatment device in which heating chambers are disposed with an intermediate transport chamber interposed therebetween when viewed in a top view, and a treatment object is stored in the heating chambers via the intermediate transport chamber, the multi-chamber heat treatment device including a gas cooling chamber which is provided in the device adjacent to the intermediate transport chamber in a top view and configured to cool the treatment object using a cooling gas; and a cooling gas circulation device which includes a gas inlet which extends toward the treatment object in the gas cooling chamber, and a gas outlet which extends toward the treatment object and faces the gas inlet are provided with the treatment object interposed therebetween, and the cooling gas circulation device being configured to blow the cooling gas from the gas inlet and exhausts the cooling gas from the gas outlet.

According to an embodiment of the present disclosure, the multi-chamber heat treatment device includes the gas inlet which extends toward the treatment object in the gas cooling chamber, and the gas outlet which extends toward the treatment object and faces the gas inlet with the treatment object interposed therebetween, blows the cooling gas from the gas inlet, and exhausts the cooling gas that has contributed to the cooling of the treatment object from the gas outlet. Thus, it is possible to provide a multi-chamber heat treatment device in which a decrease in cooling performance of the mist cooling is suppressed.

DETAILED DESCRIPTION

Figure 1:
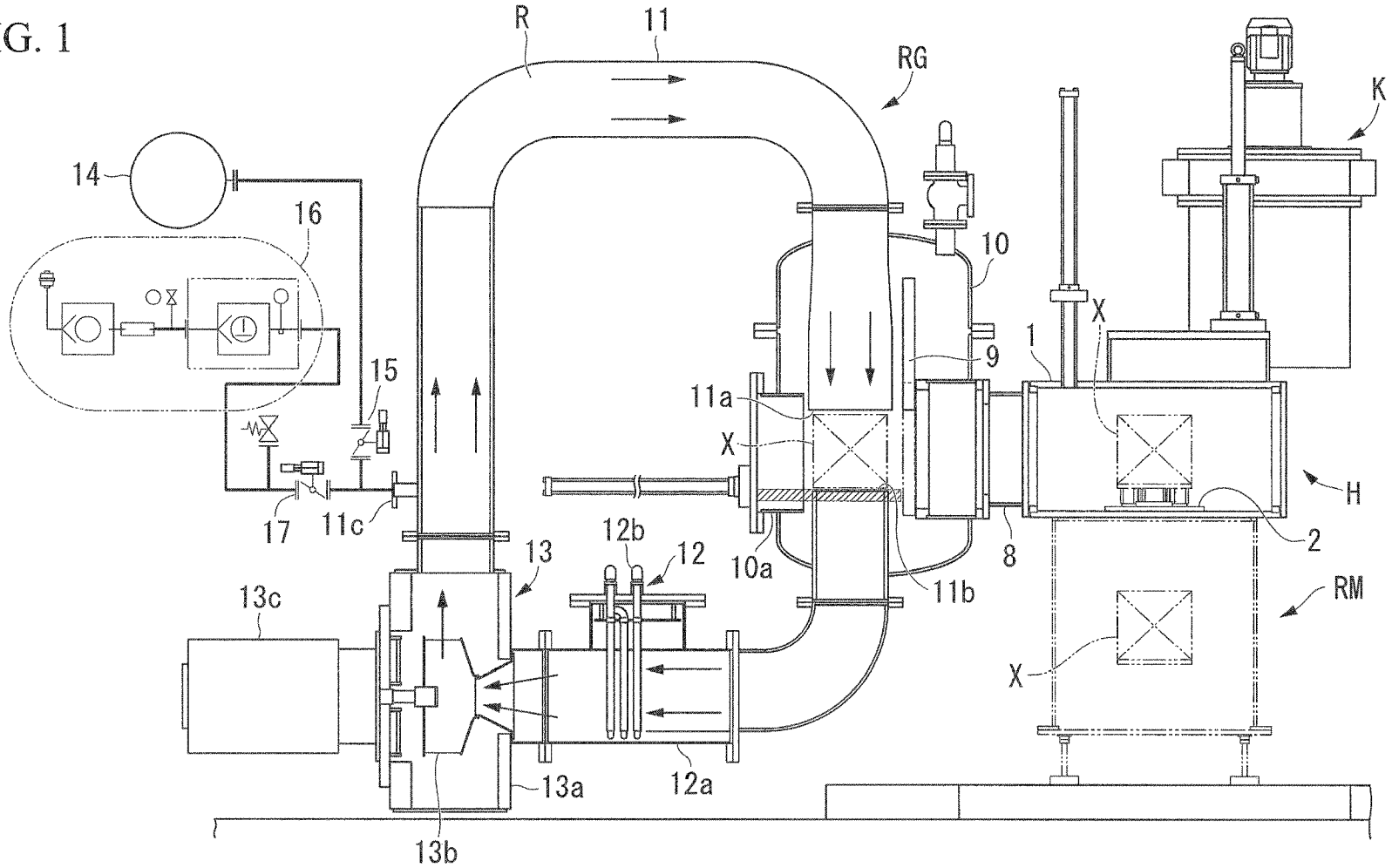
FIG. 1 is longitudinal sectional view of a multi-chamber heat treatment device according to an embodiment of the present disclosure, as viewed from the front.

Hereinafter, an embodiment of the present invention will be described with reference to drawings. As shown in FIG. 1, the multi-chamber heat treatment device according to the present embodiment is a device in which a gas cooling device RG, a mist cooling device RM and three heating devices K are united via an intermediate transport device H.

Three heating devices K connected to the intermediate transport device H are provided in the actual multi-chamber heat treatment device. However, since FIG. 1 shows a longitudinal cross section at the center of the gas cooling device RG and at the center of the intermediate transport device H in the front view of the multi-chamber heat treatment device, only one heating device K is shown in FIG. 1. Further, the multi-chamber heat treatment device includes a vacuum pump, various pipes, various valves, various lifting devices, an operation panel, a control device and the like as constituent elements which are not shown in FIGS. 1 to 4.

Figure 2:
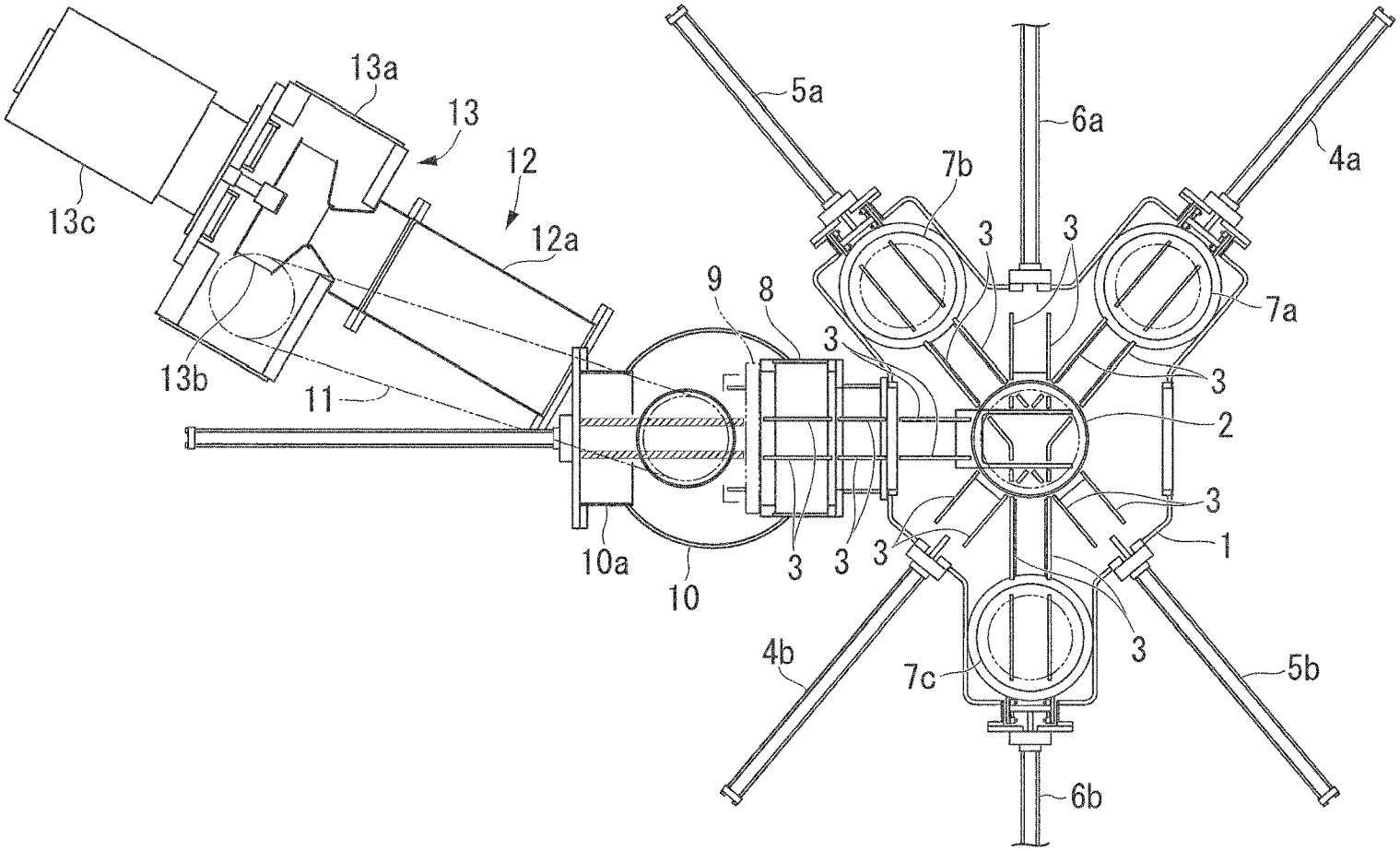
FIG. 2 is a cross-sectional view of the multi-chamber heat treatment device according to an embodiment of the present disclosure, as viewed from the top.

As shown in FIGS. 1 and 2, the intermediate transport device H includes a transport chamber 1, a mist cooling chamber lifting table 2, transport rails 3, three pairs of pusher devices 4*a*, 4*b*, 5*a*, 5*b*, 6*a* and 6*b*, three heating chamber lifting tables 7*a* to 7*c*, an expansion chamber 8, a partition door 9 and the like.

The transport chamber 1 is a container provided between the mist cooling device RM and the three heating devices K. In a floor portion of the transport chamber 1, as shown in FIG. 2, three heating chamber lifting tables 7*a* to 7*c* are disposed to surround the mist cooling chamber lifting table 2. Such an internal space of the transport chamber 1 and an internal space of an expansion chamber 8 to be described later are intermediate transport chambers in which the treatment object X moves.

The mist cooling chamber lifting table 2 is a support table on which the treatment object X is placed when the treatment object X is cooled by the mist cooling device RM, and is raised and lowered by a lifting device (not shown). That is, the treatment object X moves between the intermediate transport device H and the mist cooling chamber lifting table 2 by the operation of the lifting device in a state in which it is placed on the mist cooling chamber lifting table 2.

As shown in the drawings, the transport rails 3 are laid on the floor portion of the transport chamber 1, the mist cooling chamber lifting table 2, the heating chamber lifting tables 7*a* to 7*c*, and the floor portion of the expansion chamber 8. Such a transport rail 3 is a guide member (a guidance member) in movement of the treatment object X in the transport chamber 1 and the expansion chamber 8. The three pairs of pusher devices 4*a*, 4*b*, 5*a*, 5*b*, 6*a* and 6*b* are transportation actuators that press the treatment object X in the transport chamber 1 and the expansion chamber 8.

That is, among the three pairs of pusher devices 4*a*, 4*b*, 5*a*, 5*b*, 6*a* and 6*b*, the pair of pusher devices 4*a* and 4*b* disposed in the same straight line move the treatment object X between the mist cooling chamber lifting table 2 and the heating chamber lifting table 7*a*. Among the pair of pusher devices 4*a* and 4*b*, the pusher device 4*a* presses the treatment object X from the heating chamber lifting table 7*a* toward the mist cooling chamber lifting table 2, and the pusher device 4*b* presses the treatment object X from the mist cooling chamber lifting table 2 toward the heating chamber lifting table 7*a*.

The pair of pusher devices 5*a* and 5*b* disposed in the same linear shape also move the treatment object X between the mist cooling chamber lifting table 2 and the heating chamber lifting table 7*b*. Among the pair of pusher devices 5*a* and 5*b*, the pusher device 5*a* presses the treatment object X from the heating chamber lifting table 7*b* toward the mist cooling chamber lifting table 2, and the pusher device 5*b* presses the treatment object X from the mist cooling chamber lifting table 2 toward the heating chamber lifting table 7*b*.

The pair of pusher devices 6*a* and 6*b* disposed in the same linear shape also move the treatment object X between the mist cooling chamber lifting table 2 and the heating chamber lifting table 7*c*. That is, among the pair of pusher devices 6*a* and 6*b*, the pusher device 6*a* presses the treatment object X from the heating chamber lifting table 7*c* toward the mist cooling chamber lifting table 2, and the pusher device 6*b* presses the treatment object X from the mist cooling chamber lifting table 2 to the heating chamber lifting table 7*c*.

At the time of movement (transportation) of the treatment object X using the three pairs of pusher devices 4*a*, 4*b*, 5*a*, 5*b*, 6*a* and 6*b* as a power source, the transport rails 3 guide the pressing portions attached to the leading ends of the three pairs of pusher devices 4*a*, 4*b*, 5*a*, 5*b*, 6*a* and 6*b* to move smoothly, and also guides the treatment object X to move smoothly.

The three heating chamber lifting tables 7*a* to 7*c* are support tables on which the treatment object X is placed when the treatment object X is heated with the respective heating devices K, and are provided just below the respective heating devices K. Such heating chamber lifting tables 7*a* to 7*c* move up and down by a lifting device (not shown), thereby moving the treatment object X between the intermediate transport device H and each heating device K.

The expansion chamber 8 is a box-shaped expansion container which is connected to a side portion of the transport chamber 1 and is conveniently provided to connect the intermediate transport device H and the gas cooling device RG One end (one plane) of the expansion chamber 8 communicates with a side portion of the transport chamber 1, and a partition door 9 is provided on the other end (one plane) of the expansion chamber 8. A transport rail 3 is laid on the floor portion of such an expansion chamber 8 so that the treatment object X can move freely.

The partition door 9 is an opening and closing door that partitions the intermediate transport chamber, which is an internal space of the transport chamber 1 and the expansion chamber 8, and the gas cooling chamber, which is an internal space of the gas cooling device RG, and is provided at the other end (one plane) of the expansion chamber 8 in a vertical posture. That is, the partition door 9 moves up and down by a drive device (not shown), thereby opening or shielding the other end of the expansion chamber 8.

Next, the gas cooling device RG will be described. The gas cooling device RG is a cooling device which cools the treatment object X using a predetermined gaseous coolant (cooling gas), and, for example, nitrogen gas ($N_2$ gas) is used as a cooling gas. As shown in FIG. 1, the gas cooling device RG includes a cooling chamber 10 (gas cooling chamber), a circulation chamber 11, a gas cooler 12, a blower 13, a reserve tank 14, a first control valve 15, an exhaust pump 16, a second control valve 17 and the like.

The constituent elements other than the cooling chamber 10 (gas cooling chamber), that is, the circulation chamber 11, the gas cooler 12, the blower 13, the reserve tank 14, the first control valve 15, the exhaust pump 16, and the second control valve 17, constitute a cooling gas circulation device which blows a cooling gas from the upper side toward the treatment object X in the cooling chamber 10 and exhausts the cooling gas that has contributed to the cooling of the treatment object X from below the treatment object X.

The cooling chamber 10 is a container having a substantially rounded vertical cylindrical shape, that is, a substantially circular (annular) horizontal sectional shape, and is provided adjacent to the expansion chamber 8 constituting the intermediate transport chamber. The internal space of the cooling chamber 10 is a gas cooling chamber that performs the cooling process on the treatment object X by blowing a predetermined cooling gas toward the treatment object X. Since the internal pressure of the cooling chamber 10 is a positive pressure of 500 kPa or more, the cooling chamber 10 is formed in a shape having high pressure resistance, that is, a substantially rounded cylindrical shape.

Further, the cooling chamber 10 (gas cooling chamber) is connected to the chamber 8, in a state in which a part of the expansion chamber 8 is located therein, that is, in a state in which the partition door 9 projects inward from the side part into the cooling chamber 10. Further, a work entrance 10*a* is provided at a position facing the partition door 9 in the cooling chamber 10. The work entrance 10*a* is an opening through which the treatment object X enters and exits the cooling chamber 10.

Figure 3:
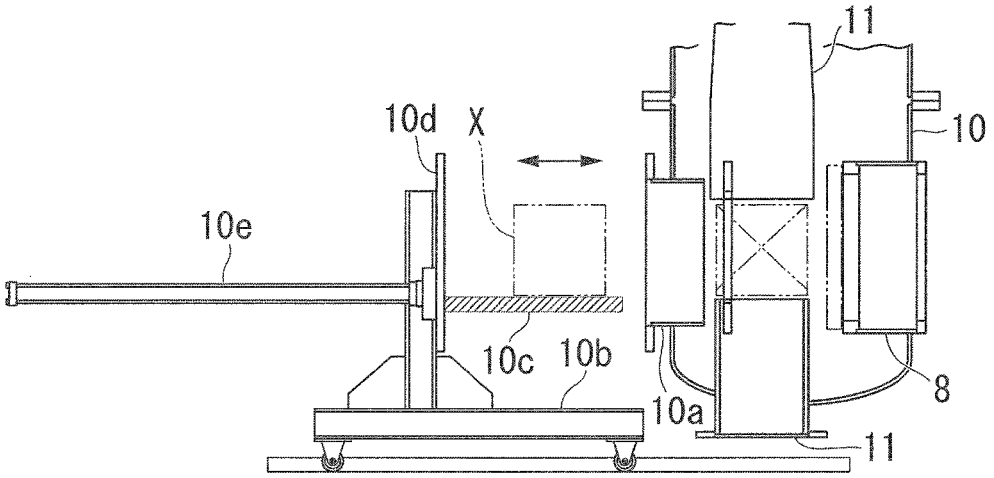
FIG. 3 is a longitudinal sectional view showing loading and unloading of a treatment object in a multi-chamber heat treatment device according to an embodiment of the present disclosure.

As shown in FIG. 3, the treatment object X is stored in the cooling chamber 10 from the work entrance 10*a* in a state in which it is mounted on the transport carriage 10*b*. The transport carriage 10*b* includes a placing table 10*c* that holds the treatment object X at a predetermined height, and is configured to be movable forward and backward with respect to the work entrance 10*a*. That is, the transport carriage 10*b* moves along the carriage rail laid on a floor surface of a building in which the multi-chamber heat treatment device is installed, thereby freely moving to move toward or away from the cooling chamber 10.

Further, a closing plate 10*d* and a loading and unloading cylinder device 10*e* are provided in the transport carriage 10*b*. The closing plate 10*d* is a plate-like member that abuts and tightly seals the work entrance 10*a* when the treatment object X is stored in the cooling chamber 10. The closing plate 10*d* is bolted to, for example, the work entrance 10*a* in a state in which it abuts the work entrance 10*a* to tightly seal the work entrance 10*a*.

The loading and unloading cylinder device 10*e* is a conveyance device that moves the treatment object X into the cooling chamber (the cooling chamber 10) and the transport chamber 1 (the intermediate transport chamber). That is, the loading and unloading cylinder device 10*e* is a pusher and puller transport device which presses the treatment object X on the placing table 10*c* to move the treatment object X on the mist cooling chamber lifting table 2 in the intermediate transport chamber, and engages with and pulls the treatment object X on the mist cooling chamber lifting table 2, thereby moving the treatment object X from the inside of the intermediate transport chamber onto the placing table 10*c*.

Here, as shown in FIG. 2, an opening for performing the loading and unloading of the treatment object X can be provided in the transport chamber 1 on the opposite side of the expansion chamber 8. Therefore, instead of the cooling chamber 10, a work entrance may be provided on the opposite side of the expansion chamber 8. In this case, the pusher and puller transport device having the same function as that of the loading and unloading cylinder device 10*e* is fixedly disposed in the cooling chamber 10, a dedicated opening and closing door is provided at the work entrance provided in the transport chamber 1, and the treatment object X is carried into the transport chamber 1 (intermediate transport chamber) from the work entrance and is placed on the mist cooling chamber lifting table 2 using a separately prepared transport carriage.

With the configuration in which the work entrance is provided in the transport chamber 1 in this manner, it is possible to fixedly install the transport device corresponding to the loading and unloading cylinder device 10*e* in the multi-chamber heat treatment device. As a result, it is possible to secure usability and durability of the multi-chamber heat treatment device.

One circular end (gas inlet 11*a*) in the circulation chamber 11 opens to the upper part (upper side) of the substantially vertical cylindrical cooling chamber 10, and the other circular end (gas outlet 11*b*) in the circulation chamber 11 opens to the lower part (lower side) of the cooling chamber 10 to face the gas inlet 11*a* with the treatment object X interposed therebetween. Such a circulation chamber 11 is a container that connects the cooling chamber 10, the gas cooler 12 and the blower 13 in an annular shape as a whole. That is, the cooling chamber 10, the circulation chamber 11, the gas cooler 12 and the blower 13 form a gas circulation passage R through which the gas is circulated, so that the cooling gas flows downward from the gas inlet 11*a*, that is, flows toward the gas outlet 11*b*.

In such a gas circulation passage R, a clockwise flow of the cooling gas as indicated by an arrow in FIG. 1 is generated as the blower 13 operates. Further, the treatment object X is disposed between the gas inlet 11*a* and the gas outlet 11*b*. The cooling gas blown downward from the gas inlet 11*a* is blown toward the treatment object X from above to cool the treatment object X. Further, the cooling gas that has contributed to the cooling of the treatment object X flows to the lower part of the treatment object X and flows into the gas outlet 11*b*, thereby being recovered in the circulation chamber 11.

Here, as shown in FIG. 1, the gas inlet 11*a* extends just above the treatment object X in the gas cooling chamber, and the gas outlet 11*b* extends just below the treatment object X in the gas cooling chamber. Accordingly, the cooling gas blown out from the gas inlet 11*a* is not dispersed in the gas cooling chamber, and almost all of the cooling gas is blown to the treatment object X. Similarly, the cooling gas that has contributed to the cooling of the treatment object X is not dispersed in the gas cooling chamber, and almost all of the cooling gas is recovered in the circulation chamber 11.

Further, as shown in FIGS. 1 and 2, the positions of the circular gas inlet 11*a* and the gas outlet 11*b* in the horizontal direction with respect to the substantially circular cooling chamber 10 are not concentric, and the centers thereof are displaced from each other. That is, the center of the gas inlet 11*a* and the center of the gas outlet 11*b* in the horizontal direction are concentric with each other, but the center of the gas inlet 11*a* and the center of the gas outlet 11*b* are displaced to be closer to the side of the work entrance 10*a* than the center of the cooling chamber 10, that is, to the side opposite to the partition door 9.

Here, as described above, the expansion chamber 8 is connected to the cooling chamber 10 in a state in which the partition door 9 protrudes from the side into the gas cooling chamber, but is a member for ensuring the pressure resistance of the cooling chamber 10. That is, although the expansion chamber 8 and the cooling chamber 10 are connected to each other by welding, when the partition door 9 approaches the side wall of the cooling chamber 10, because the welding line becomes complicated, it is difficult to ensure sufficient welding quality. Under such circumstances, the expansion chamber 8 is connected to the cooling chamber 10 in a state in which the partition door 9 protrudes from the side into the gas cooling chamber, that is, in a state in which a part of the expansion chamber 8 is located therein.

However, since the partition door 9 protrudes from the side into the gas cooling chamber, it is not possible to position the center of the gas inlet 11*a* and the center of the gas outlet 11*b* to be concentric with the center of the cooling chamber 10. Here, by increasing the diameter of the cooling chamber 10, that is, by enlarging the size, it is possible to position the center of the gas inlet 11*a* and the center of the gas outlet 11*b* to be concentric with the center of the cooling chamber 10. However, in this case, the volume of the gas cooling chamber (cooling space) increases and the cooling efficiency decreases. For this reason, by displacing the gas inlet 11*a* and the gas outlet 11*b* in the horizontal direction with respect to the cooling chamber 10, the diameter of the cooling chamber 10 is made as small as possible.

The gas cooler 12 is provided on the downstream side of the gas outlet 11*b* and on the upstream side of the blower 13 in the aforementioned gas circulation passage R, and is a heat exchanger including a gas cooling chamber 12*a* and a heat transfer tube 12*b*. The gas cooling chamber 12*a* is a cylindrical body, one end of which communicates with the circulation chamber 11 and the other end of which communicates with the blower 13 in the extending direction thereof. The heat transfer tube 12*b* is a metal tube extending in a serpentine shape provided in the gas cooling chamber 12*a*, and a predetermined liquid refrigerant is inserted into the metal tube. Such a gas cooler 12 cools the cooling gas flowing from one end to the other end of the circulation chamber 11 by heat exchange with the liquid refrigerant in the heat transfer tube 12*b*.

Here, the cooling gas contributing to the cooling of the treatment object X in the cooling chamber 10 (gas cooling chamber), which is exhausted from the cooling chamber 10 (gas cooling chamber), is heated by the heat held by the treatment object X. The gas cooler 12 cools the thus-heated cooling gas to, for example, the temperature (the temperature of the cooling gas blown out from the gas inlet 11*a*) before it was provided for cooling of the treatment object X.

The blower 13 is provided at the intermediate position of the gas circulation passage R, that is, on the upstream side of the circulation chamber 11 and on the downstream side of the gas cooler 12, and includes a fan casing 13*a*, a turbo fan 13*b*, and a water cooling motor 13*c*. The fan casing 13*a* is a cylindrical body, and a portion of the fan casing 13*a* located on an inflow side of the cooling gas communicates with the other end of the gas cooling chamber 12*a*, and a portion of the fan casing 13*a* located on an outflow side of the cooling gas communicates with the circulation chamber 11. The turbo fan 13*b* is a centrifugal fan stored in such a fan casing 13*a*. The water cooling motor 13*c* is a driving unit that rotationally drives such a turbo fan 13*b*.

Figure 4:
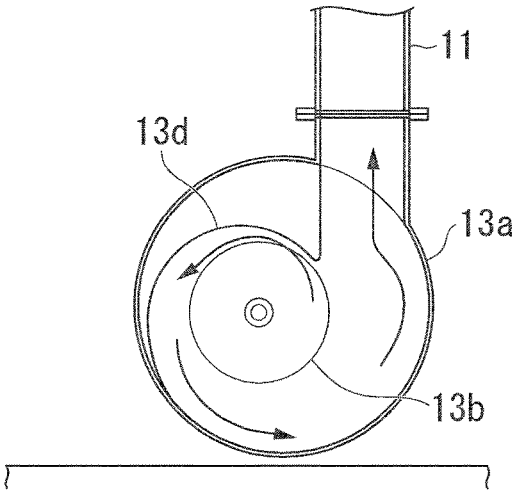
FIG. 4 is a longitudinal sectional view showing a blower in the multi-chamber heat treatment device according to an embodiment of the present disclosure.

As shown in FIGS. 1 and 4, the gas cooling chamber 12*a* is a horizontally placed container having a substantially cylindrical shape, and a rotary axis of the turbo fan 13*b* is set in the horizontal direction similarly to the central axis of the gas cooling chamber 12*a*. As shown in FIG. 4, the rotary shaft of the turbo fan 13*b* is provided at a position displaced from the central axis of the gas cooling chamber 12*a* by a predetermined dimension in the horizontal direction. Further, as shown in FIG. 4, a guide plate 13*d* which smoothly enlarges an upper flow passage of the turbo fan 13*b* in the counterclockwise direction is provided in the gas cooling chamber 12*a*, and the upper passage of the turbo fan 13*b* is narrowed toward the clockwise direction.

In such a blower 13, as shown in FIG. 4, when the water cooling motor 13*c* operates and the turbo fan 13*b* rotates counterclockwise as viewed from the water cooling motor 13*c* side, cooling gas flows as indicated by the arrow. That is, in the blower 13, the cooling gas is suctioned into the blower 13 from one end of the fan casing 13*a* located in front of the rotary axis of the turbo fan 13*b*, is sent into the blower 13 in the counterclockwise direction when viewed from the water cooling motor 13*c* side, and is further guided by the guide plate 13*d*. Therefore, the cooling gas is sent from the other end of the fan casing 13*a* located in the direction orthogonal to the rotary axis of the turbo fan 13*b*. As a result, a clockwise flow of the cooling gas as indicated by an arrow in FIG. 1 is generated in the gas circulation passage R by operating the blower 13.

In this manner, the gas circulation passage R is formed by interposing the gas cooling chamber 12*a* and the fan casing 13*a* in the intermediate part of the circulation chamber 11. More specifically, the gas circulation passage R is formed by interposing the gas cooling chamber 12*a* to be located on the upstream side of the fan casing 13*a* in the direction in which the cooling gas flows. Further, in the circulation chamber 11 forming such a gas circulation passage R, an air supply and exhaust port 11*c* is provided on the downstream side of the fan casing 13*a*.

A reserve tank 14 is a gas tank that holds a predetermined amount of nitrogen gas (cooling gas) in a high pressure state of about 850 kPa, and supplies the cooling gas to the air supply and exhaust port 11*c* via the first control valve 15. The first control valve 15 is an on-off valve that allows and blocks passage of the cooling gas. That is, when the first control valve 15 is in the closed state, the supply of the cooling gas from the reserve tank 14 to the air supply and exhaust port 11*c* is blocked, and when the first control valve 15 is in an open state, the cooling gas is supplied from the reserve tank 14 to the air supply and exhaust port 11*c*.

The exhaust pump 16 is connected to the air supply and exhaust port 11*c* via a second control valve 17, and exhausts the cooling gas in the gas circulation passage R to the outside via the air supply and exhaust port 11*c*. The second control valve 17 is an on-off valve that determines the flow of the cooling gas from the air supply and exhaust port 11*c* to the exhaust pump 16. That is, when the second control valve 17 is in the closed state, the flow (exhaust) of the cooling gas from the air supply and exhaust port 11*c* to the exhaust pump 16 is blocked, and when the second control valve 17 is in the open state, the flow of the cooling gas from the air supply and exhaust port 11*c* to the exhaust pump 16 is permitted.

Further, the mist cooling device RM is a device which cools the treatment object X using the mist of a predetermined cooling medium, and is provided below the transport chamber 1. The mist cooling device RM performs cooling (mist cooling), by injecting the mist of the cooling medium with respect to the treatment object X stored in the chamber in a state in which it is placed on the mist cooling chamber lifting table 2, from nozzles provided around the treatment object X. The internal space of the mist cooling device RM is a mist cooling chamber, and the cooling medium is, for example, water.

Three heating devices K are devices that perform the heat treatment on the treatment object X and are provided above the transport chamber 1. Each heating device K includes a chamber, electric heaters, a vacuum pump, and the like. Further, each heating device K places the treatment object X stored in the chamber while being placed on the heating chamber lifting tables 7*a* to 7*c* under a predetermined reduced pressure atmosphere using a vacuum pump, and uniformly heats the treatment object X by the heaters provided around the treatment object X under the reduced pressure atmosphere. The internal space of each heating device K is an individual heating chamber.

As described above, in the multi-chamber heat treatment device according to the present embodiment, three (plural) heating chambers are disposed with the intermediate transport chamber interposed therebetween in a top view, and the treatment object X is stored in the heating chamber via the intermediate transport chamber. Further, such a multi-chamber heat treatment device includes, as constituent elements, an operation panel (not shown) through which an operator inputs setting information such as heat treatment conditions, a control device which controls various driving units such as the respective pusher devices 4*a*, 4*b*, 5*a*, 5*b*, 6*a* and 6*b*, the partition door 9, the water cooling motor 13*c*, the first control valve 15, the exhaust pump 16 and the second control valve 17, on the basis of and setting information and a control program stored in advance.

Next, the operation of the multi-chamber heat treatment device configured in this manner, particularly, the cooling operation of the treatment object X in the gas cooling device RG (gas cooling chamber) will be described in detail. Hereinafter, as an example of the heat treatment performed on the treatment object X using the multi-chamber heat treatment device, an operation when a quenching treatment is performed on the treatment object X using a single heating device K (heating chamber) and a gas cooling device RG (gas cooling chamber) will be described.

First, the operator manually operates the transport carriage 10*b* to carry the treatment object X into the cooling chamber 10 (gas cooling chamber). Further, the operator tightly seals the work entrance 10*a* by bolting the closing plate 10*d* to the work entrance 10*a*, thereby completing the preparation work. Further, the operator manually operates the operation panel to set the heat treatment condition, and further instructs the control device to start the heat treatment.

As a result, the control device operates the vacuum pump to set the interior of the gas cooling chamber (cooling chamber 10) and the intermediate transport chamber (the expansion chamber 8 and the transport chamber 1) to a predetermined vacuum atmosphere, and operates the loading and unloading cylinder device 10*e* to move the treatment object X in the cooling chamber 10 onto the mist cooling chamber lifting table 2 in the transport chamber 1. Further, for example, the control device moves the treatment object X onto the heating chamber lifting table 7*c* by operating the pusher device 6*a*, and further moves the treatment object X to the heating device K (heating chamber) located just above the heating chamber lifting table 7*c* to cause the heating device K to perform a heating process according to the heat treatment condition for the treatment object X.

Further, the control device operates the pusher device 6*b* to move the treatment object X subjected to the heating process from the top of the heating chamber lifting table 7*c* onto the mist cooling chamber lifting table 2. Furthermore, the control device operates the loading and unloading cylinder device 10*e* to move the treatment object X on the mist cooling chamber lifting table 2 into the cooling chamber 10. When moving the treatment object X, the control device allows the communication state between the expansion chamber 8 and the cooling chamber 10 by raising the partition door 9, and moves the treatment object X to the cooling chamber 10. When the movement of the treatment object X to the cooling chamber 10 is completed, the control device lowers the partition door 9 to shut off the communication state between the expansion chamber 8 and the cooling chamber 10. As a result, the cooling chamber 10 (gas cooling chamber) is completely isolated from the expansion chamber 8 and the transport chamber (intermediate transport chamber).

In this state, the control device changes the first control valve 15 from the closed state to the open state, and sets the second control valve 17 to the closed state, thereby starting the supply of cooling gas (nitrogen gas) from the air supply and exhaust port 11*c* to the gas circulation passage R. Further, when a predetermined amount of cooling gas is supplied into the gas circulation passage R, the control device changes the first control valve 15 from the open state to the closed state. The control device operates the water cooling motor 13*c* to start the circulation of the cooling gas in the gas circulation passage R and to start the supply of the liquid refrigerant to the heat transfer tube 12*b*, thereby starting the cooling process of the treatment object X according to the heat treatment conditions.

In the cooling process of the treatment object X in such a gas cooling device RG, since the treatment object X is located just below the gas inlet 11*a* and just above the gas outlet 11*b*, the cooling gas is blown toward the treatment object X from just above the treatment object X, and the cooling gas contributing to the cooling flows out from just below the treatment object X and flows into the gas outlet 11*b*.

That is, the cooling gas flowing out from the gas inlet 11*a* to just above the treatment object X intensively contributes to the cooling of the treatment object X, is hardly diffused to regions other than the treatment object X in the cooling chamber 10 (gas cooling chamber), and is exhausted to the circulation chamber 11 from just below the treatment object X. Therefore, according to the gas cooling device RG, since most of the cold heat of the cooling gas is used for cooling the treatment object X, it is possible to achieve gas cooling in which deterioration of cooling performance of the mist cooling is suppressed as much as possible.

Here, in the gas cooling device RG, in the cooling chamber 10 (gas cooling chamber), the gas inlet 11*a* extends to an adjacent position just above the treatment object X and the gas outlet 11*b* extends to an adjacent position just below the treatment object X to improve the cooling efficiency as much as possible. However, the distance between the gas inlet 11*a* and the treatment object X, and the distance between the gas outlet 11*b* and the treatment object X may be slightly large. For example, when heat-treating the objects X to be treated of various sizes by the gas cooling device RG, it is necessary to secure the distance between the gas inlet 11*a* and the treatment object X, and the distance between the gas outlet 11*b* and the treatment object X in accordance with the size of the treatment object X.

When the cooling of the treatment object X using such a cooling gas is completed, the control device changes the state of the second control valve 17 from the closed state to the open state and operates the exhaust pump 16, thereby exhausting the cooling gas in the gas circulation passage R from the air supply and exhaust port 11*c* to the outside. As a result, since the cooling gas (nitrogen gas) is eliminated from the interior of the gas circulation passage R and the interior of the cooling chamber 10 (gas cooling chamber), by causing the closing plate 10*d* to deviate from the work entrance 10*a*, the treatment object X can be carried out to the outside of the cooling chamber 10 from the work entrance 10*a*.

In addition, according to the gas cooling device RG, by providing the gas circulation passage R, the cooling gas heated by being supplied for cooling the treatment object X is cooled and used again for cooling the treatment object X. Accordingly, the amount of cooling gas used can be greatly reduced as compared to a case in which the cooling gas supplied for cooling the treatment object X is simply discarded.

Further, according to the gas cooling device RG, since the work entrance 10*a* is provided in the cooling chamber 10, it is possible to easily discharge the treatment object X after quenching to the outside. In the case where the work entrance is provided in the transport chamber 1 as described above, in order to carry out the treatment object X after quenching to the outside, since the treatment object X in the cooling chamber 10 (cooling chamber) is required to be moved into the transport chamber 1 (intermediate transport chamber) again, it takes time to carry out the treatment object X.

Furthermore, according to the multi-chamber heat treatment device, since the mist cooling device RM is provided in addition to the gas cooling device RG, it is possible to selectively use the gas cooling device RG and the mist cooling device RM according to necessity, and usability is improved. The mist cooling device RM may be omitted as necessary. Instead of the mist cooling device RM, an oil cooling device (oil cooling chamber) which cools the treatment object using a predetermined cooling oil may be provided.

Further, the present disclosure is not limited to the above embodiment, and for example, the following modified examples are considered. (1) In the above embodiment, the mist cooling device RM is provided in addition to the gas cooling device RG, but the present disclosure is not limited thereto. By removing the mist cooling device RM, it is possible to install other devices at the installation location of the mist cooling device RM. Accordingly, for example, a dedicated chamber (loading and unloading chamber) may be provided at the installation place of the mist cooling device RM to perform carrying-in and carrying-out of the treatment object X. In the case of adopting such a configuration, since the position in the vertical direction in which the treatment object X is carried in and out is lower than the configuration in the above embodiment, the workability of the operator concerning carrying-in and carrying-out of the treatment object X is excellent.

(2) Further, in the case of providing a loading and unloading chamber in place of the mist cooling device RM as described above, it is possible to use the loading and unloading chamber as a preheating chamber by providing a heating function in the loading and unloading chamber. That is, prior to the heating (main heating) of the treatment object X using the heating device K (heating chamber), the treatment object X is preheated to a predetermined temperature in the loading and unloading chamber (preheating chamber), and the pretreated treatment object X is moved to the heating device K (heating chamber) and is subjected to the main heating. By adopting such a configuration, it is possible to shorten the time of the main heating and to shorten the heat treatment time.

(3) In the above embodiment, the circulation chamber 11 is provided to sandwich the treatment object X between the gas inlet 11*a* and the gas outlet 11*b* in the vertical direction. However, the present disclosure is not limited thereto. For example, the gas inlet 11*a* and the gas outlet 11*b* may be opposed to each other to sandwich the treatment object X in the horizontal direction.

(4) In the above embodiment, the gas circulation passage R is provided. However, the present disclosure is not limited thereto. The gas circulation passage R may be removed and the cooling gas supplied for cooling the treatment object X may be discarded.

(5) In the above embodiment, three heating devices K (heating chambers) are provided. However, the present disclosure is not limited thereto. The number of heating devices K (heating chambers) may be one, two or three or more.

INDUSTRIAL APPLICABILITY

According to the present disclosure, it is possible to provide a multi-chamber heat treatment device in which a decrease in cooling performance of the mist cooling is suppressed.

What is claimed is:

1. A multi-chamber heat treatment device in which heating chambers are disposed with an intermediate transport chamber interposed between the heating chambers in a top view, the multi-chamber heat treatment device comprising:

a first gas cooling chamber provided adjacent to the intermediate transport chamber in the top view, wherein the first gas cooling chamber is configured to cool a treatment object using a cooling gas; and a cooling gas circulation device comprising:

a gas circulation passage having a first end and a second end, wherein the first end is a gas inlet which passes through a top surface of the first gas cooling chamber and extends toward a first position adjacent to a top surface of the treatment object in the first gas cooling chamber, wherein the second end is a gas outlet which passes through a bottom surface of the first gas cooling chamber and extends toward a second position adjacent to a bottom surface of the treatment object, wherein the gas outlet faces the gas inlet with the treatment object interposed between the gas inlet and the gas outlet, wherein the cooling gas circulation device is configured to blow the cooling gas through the gas inlet and exhaust the cooling gas through the gas outlet, and wherein the cooling gas is circulated via the first gas cooling chamber, a blower provided at an intermediate portion of the gas circulation passage, wherein the blower is configured to allow the cooling gas to flow through the gas circulation passage, and a gas cooler provided on an upstream side of the blower, wherein the gas cooler is configured to cool the cooling gas exhausted from the first gas cooling chamber, wherein the first gas cooling chamber has an annular horizontal cross sectional shape in the top view; and a center of the gas inlet in the cooling gas circulation device is displaced in a horizontal direction with respect to a center of the first gas cooling chamber.

2. The multi-chamber heat treatment device according to claim 1, further comprising:

a partition door configured to partition the first gas cooling chamber and the intermediate transport chamber, wherein the partition door projects into the first gas cooling chamber.

3. The multi-chamber heat treatment device according to claim 1, further comprising:

a mist cooling chamber below the intermediate transport chamber, wherein the mist cooling chamber is configured to cool the treatment object using a mist of a predetermined cooling medium.

4. The multi-chamber heat treatment device according to claim 1, further comprising:

an oil cooling chamber below the intermediate transport chamber, wherein the oil cooling chamber is configured to cool the treatment object using a predetermined cooling oil.

5. The multi-chamber heat treatment device according to claim 1, wherein the first gas cooling chamber further comprises a work entrance through which the treatment object enters and exits between the first gas cooling chamber and an outside of the multi-chamber heat treatment device.

6. The multi-chamber heat treatment device according to claim 1, wherein the gas cooler is a heat exchanger including a second gas cooling chamber and a heat transfer tube.

7. The multi-chamber heat treatment device according to claim 6, wherein the blower comprises a fan casing, a turbo fan, and a water cooling motor, wherein the second gas cooling chamber is a horizontally disposed container having a cylindrical shape and a central axis set in a horizontal direction, and wherein the turbo fan comprises a rotary axis set in the horizontal direction.

8. The multi-chamber heat treatment device according to claim 1, wherein the gas circulation passage comprises a first chamber and a second chamber, wherein the first chamber connects the blower and the first gas cooling chamber, and wherein the second chamber connects the first gas cooling chamber and the gas cooler.

9. The multi-chamber heat treatment device according to claim 1, wherein the first gas cooling chamber is a container having a rounded cylindrical shape.

10. The multi-chamber heat treatment device according to claim 1, wherein the first position is closer to the top surface of the treatment object than the top surface of the first gas cooling chamber, wherein the second position is closer to the bottom surface of the treatment object than the bottom surface of the first gas cooling chamber, and wherein the gas inlet extends to the first position and the gas outlet extends to the second position.

11. The multi-chamber heat treatment device according to claim 10, wherein the gas inlet and the top surface of the treatment object are adjacent to each other such that the cooling gas blown through the gas inlet is not dispersed in the first gas cooling chamber before the cooling gas is blown to the treatment object, and wherein the gas outlet and the bottom surface of the treatment object are adjacent to each other such that the cooling gas that has contributed to cooling of the treatment object is not dispersed in the first gas cooling chamber before the cooling gas is blown to the gas outlet.

* * * * *